US008789723B2

(12) United States Patent
Gunderson

(10) Patent No.: US 8,789,723 B2
(45) Date of Patent: Jul. 29, 2014

(54) MULTIPLE DRINK LID DISPENSER

(71) Applicant: Jeffrey E. Gunderson, Stoughton, WI (US)

(72) Inventor: Jeffrey E. Gunderson, Stoughton, WI (US)

(73) Assignee: The Vollrath Company, LLC, Sheboygan, WI (US)

( * ) Notice: Subject to any disclaimer, the term of this patent is extended or adjusted under 35 U.S.C. 154(b) by 0 days.

(21) Appl. No.: 13/719,871

(22) Filed: Dec. 19, 2012

(65) Prior Publication Data

US 2014/0166689 A1 Jun. 19, 2014

(51) Int. Cl.
*A47F 1/08* (2006.01)

(52) U.S. Cl.
USPC ..... 221/221; 221/262; 221/296; 221/299

(58) Field of Classification Search
CPC ..... A47F 1/08; A47F 1/1085; A47F 1/10; A47F 1/106
USPC ..... 221/296, 289, 297, 299, 300, 221, 223, 221/262
See application file for complete search history.

(56) References Cited

U.S. PATENT DOCUMENTS 4,682,826 A 7/1987 Mestdagh
5,131,562 A 7/1992 Brown
5,383,571 A 1/1995 Gunderson
5,816,444 A * 10/1998 David ..... 221/289
5,960,989 A 10/1999 Gunderson
5,975,839 A * 11/1999 Ashby ..... 414/798.1
6,117,391 A * 9/2000 Mootz et al. ..... 422/65
6,471,092 B1 10/2002 Thompson
6,474,503 B2 * 11/2002 Davis ..... 221/223
7,207,462 B2 4/2007 Gunderson et al.
7,234,611 B2 * 6/2007 Hecht ..... 221/232
7,270,248 B2 * 9/2007 Schroeder ..... 221/221
7,337,919 B2 * 3/2008 Walsh et al. ..... 221/221
7,422,127 B2 * 9/2008 Christoffersen et al. ..... 221/40
7,673,773 B1 * 3/2010 Walsh et al. ..... 221/270
7,882,980 B1 2/2011 Horn et al.

(Continued)

FOREIGN PATENT DOCUMENTS

JP 2006-298387 11/2006

OTHER PUBLICATIONS

International Search Report and Written Opinion for International Application No. PCT/US2013/075780, mail date Apr. 1, 2014, 11 pages.

*Primary Examiner* — Patrick Mackey
(74) *Attorney, Agent, or Firm* — Foley & Lardner LLP

(57) ABSTRACT

A traveler has a platform which moves vertically within a carriage. By depressing one of three keys, the platform is depressed against a spring to the depth of one, two or three lids to be dispensed from a stack. With the desired key depressed, the entire carriage moves downwardly within a housing which has cams mounted to its side walls which displace spring mounted side separators which extend inwardly to separate the remainder of the stack of lids from the selected lids. The extended separators urge the selected lids past protruding pagers which support the remainder stack and prevent it from being dispensed. Once past the pagers, the selected lids are presented for one-handed removal by a user at a housing outlet. Constant force springs mounted between the carriage and the housing return the carriage to its initial position once pressure on the selected key is released.

18 Claims, 4 Drawing Sheets

(56) References Cited

U.S. PATENT DOCUMENTS

| | | | | |
|---|---|---|---|---|
| 7,959,402 | B2 * | 6/2011 | Hashinokuchi | 414/798 |
| 8,016,158 | B2 * | 9/2011 | Walsh et al. | 221/289 |
| 8,025,181 | B1 | 9/2011 | Horn et al. | |
| 2006/0157493 | A1 * | 7/2006 | Christoffersen et al. | 221/36 |
| 2006/0249526 | A1 | 11/2006 | Walsh et al. | |
| 2006/0249527 | A1 | 11/2006 | Walsh et al. | |
| 2007/0228067 | A1 | 10/2007 | Hecht | |
| 2012/0012609 | A1 | 1/2012 | Ognissanti et al. | |

* cited by examiner

MULTIPLE DRINK LID DISPENSER

CROSS REFERENCES TO RELATED APPLICATIONS

Not applicable.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to dispensers for drink container lids in general, and more particularly, to simultaneous dispensers of one or more lids.

Beverage containers provided to customers at fast food restaurants, particularly at drive-up windows, will usually be provided with disposable plastic lids to restrict spilling of the drinks within the customer's vehicle. Time to fill an order is of concern in this type of restaurant service, so even a few seconds per order are significant. Often the food service worker who is completing the customer's order will have multiple drinks which must receive lids before being passed to the customer. Some beverage container lid dispensers present a single lid for extraction in a repeatable and hygienic fashion, but only permit the dispensing of one lid at a time. A simple unrestricted stack of lids permits ready access of as many lids at once as the operator desires, but the accessing of a precise number of lids is problematic.

What is needed is a device which dispenses the exact quantity of lids that the operator requires, and does it repeatably and hygienically.

SUMMARY OF THE INVENTION

The lid dispenser of this invention allows an operator to select and remove with precision a desired quantity of lids from a stack which is maintained in a neat array. The dispenser has a traveler with a platform which moves vertically within a carriage and which supports a stack of lids. The carriage is mounted for axial movement within a housing, and is urged towards a retracted position by two constant force springs which extend between the carriage and the housing. The operator engages and moves one of three keys towards a housing outlet, thereby depressing the platform against a spring to the depth of one, two or three lids to be dispensed from the stack. With the desired key depressed, the entire carriage moves downwardly within the housing, bringing it past cams which are mounted to the housing side walls. The cams cause spring-mounted side separators to extend inwardly to separate an upper remainder stack of lids from the one, two, or three selected lids. As the carriage is further depressed, the extended separators urge the selected lids past protruding pagers which support the remainder stack and prevent it from being dispensed. Once past the pagers, the selected lids are presented for one-handed removal by a user at a housing outlet. Once the user releases pressure on the selected key, the constant force springs return the carriage to its initial position.

It is an object of the present invention to provider a dispenser which permits an operator to precisely and repeatably dispense a desired quantity of lids.

It is another object of the present invention to provide a dispenser which can accommodate a variety of lid types and sizes by simple adjustments.

Further objects, features and advantages of the invention will be apparent from the following detailed description when taken in conjunction with the accompanying drawings.

DESCRIPTION OF THE PREFERRED EMBODIMENTS

Figure 1:
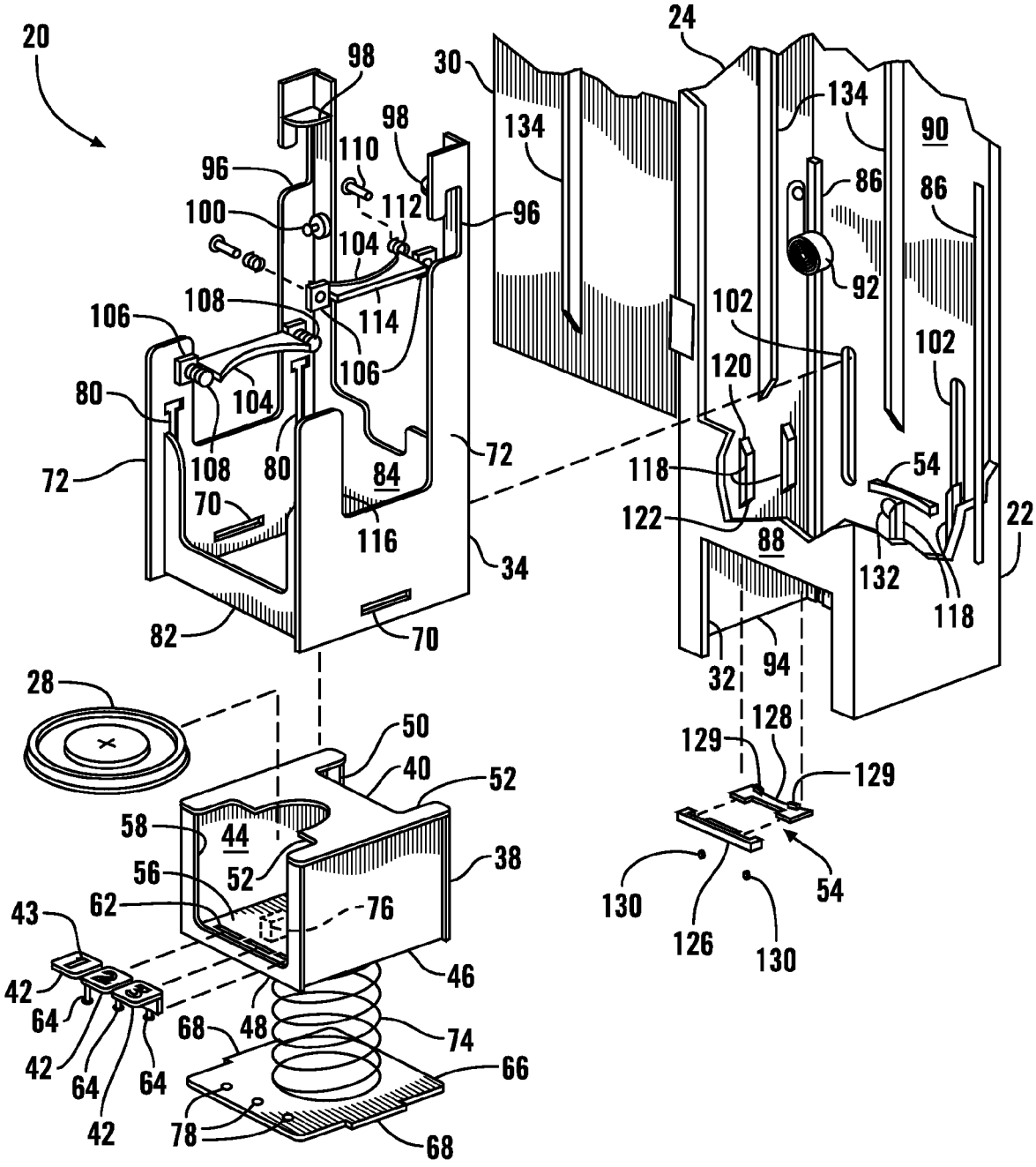
FIG. 1 is an exploded isometric view of the lid dispenser of this invention.

Referring more particularly to FIGS. 1-7 wherein like numbers refer to similar parts, a lid dispenser 20 is shown in FIG. 1. The lid dispenser 20 has a vertically extending housing 22 which defines an interior 24 which receives a stack 26 of disposable drink container lids 28, shown in FIG. 2. The housing 22 has a loading door 30 through which the stack of lids is inserted. The stack of lids defines an axial direction extending upwardly through the housing interior 24. The housing may be mounted to a wall or a stand, not shown, or in some other fashion to position the housing outlet 32 sufficiently far above any underlying surface to allow the extension of an internal carriage 34. A traveler 38 has an upper platform 40 which receives the lids which are to be dispensed. The traveler moves axially within the carriage 34. Three labeled keys 42 are mounted to the traveler, and allow an operator to select the exact number of lids which it is desired to be dispensed. Each key 42 has an indicium 43 corresponding to the number of lids which will be dispensed by pressing that particular key, for example the numerals "1", "2", or "3". The indicia 43 may be applied labels or may be formed integrally with the keys.

The upper platform 40 may be fabricated of transparent plastic and is fastened to a left side wall 44 and a right side wall 46 which are joined together by a front wall 48 and a rear wall 50. The platform 40 has front and back cut-aways 52 to allow it to clear the pager assemblies 54 which are mounted to the interior of the housing 22 when the traveler is depressed. The traveler 38 has a lower wall 56 which is parallel to the platform 40 and spaced downwardly from the platform. The traveler 38 front wall 48 has a hand opening 58 which allows an operator to reach into the interior of the traveler to engage the lid or lids supported on the platform 40. Each key 42 has a rectangular plastic post 60, which elevates the key above the lower wall 56, and which extends through a key opening 62 in the lower wall.

Each key post 60 has a travel adjustment screw 64 which limits the extent to which the key can be depressed. The screws 64 are threaded to the posts 60, so that the extension of the screw can be adjusted. The traveler 38 is retained within the carriage 34 by a bottom wall 66 which is connected to the underside of the carriage by two side tabs 68 which are received in slots 70 in the side walls 72 of the carriage. A coil spring 74 extends between the bottom wall 66 and the lower wall 56 of the traveler. A rectangular spring retention member 76 may extend downwardly from the traveler lower wall which serves to center the spring 74. The carriage bottom wall 66 has a screw adjustment hole 78 positioned beneath each screw head of the travel adjustment screws 64. The holes 78 are small enough that the heads of the screws 64 still can bear against the carriage bottom wall 66, but large enough to permit a screwdriver to be inserted through the holes to adjust the extension of the screws beneath the key posts 60.

The greater the extension of an adjustment screw 64, the shorter distance that the traveler can move within the carriage before the adjustment screw engages the carriage bottom wall 66. Thus the adjustment screw 64 will extend the most beneath the key marked for dispensing one lid, and least beneath the key marked for dispensing three lids. The length of key travel will correspond approximately to the height of the number of lids which it is desired to dispense.

The traveler front wall 48 and rear wall 50 extend to the sides of the side walls 44, 46, thereby defining protrusions which are received within recessed vertical tracks 80 formed on the interiors of the carriage side walls 72. The upper termination of the tracks 80 limits the extent to which the spring 74 can urge the traveler upwards.

The carriage side walls 72 are connected by a parallel front wall 82 and a rear wall 84. The carriage side walls 72 project to the front and the rear of the front and rear walls 82, 84, thereby defining protrusions which are received within recessed vertical tracks 86 formed in the front wall 88 and rear wall 90 of the housing 22. The carriage 34 is thus constrained to move axially within the housing 22. Constant force springs 92 are fixed at one end to the side walls 94 of the housing 22 above the carriage. The coiled portions of the constant force springs 92 extend through access slots 96 in the carriage side walls 72 and engage beneath narrow shelves 98 which extend between the carriage rear wall 84 and the side walls 72. The constant force springs 92 urge the carriage upwardly and serve to restore the carriage to its uppermost position after a dispensing action. Threaded retention stops 100 extend through the carriage rear wall 84 and are received within vertical travel slots 102. The stops limit the travel of the carriage 34, preventing it from being removed from the housing on the lower end of its travel, and from being retracted too far within the housing on the upper end of its travel.

The carriage is provided with two side separators 104 which are mounted for movement perpendicular to the axial direction towards the interior 24 of the housing 22. Each side separator 104 is an arcuate blade-like member, having a radius approximate to that of the lids to be dispensed. Each side separator 104 is mounted between two slide members 106 which ride horizontally on separator posts 108 which project inwardly from the carriage side walls. The separator posts 108 are positioned on opposite sides of clearance openings 116. The posts 108 may be fabricated of a low-friction material such as Nylon plastic. A screw 110 extends into each post 108 and retains a spring 112 which extends between the screw and the separator slide member 106. Thus mounted on the posts 108, the side separators 104 travel smoothly along a path perpendicular to the side walls 72 of the carriage 34.

Each side separator 104 has a cam follower member 114 which extends through the clearance opening 116 to engage two parallel axially extending cams 118. The cams may be bars with inlet ramps 120 and outlet ramps 122. Thus as the carriage 34 moves downwardly within the housing 22, the cam followers engage the cams 118 driving the side separators 104 inwardly along paths perpendicular to the axis of the lid stack, as discussed in more detail below.

Figure 6:
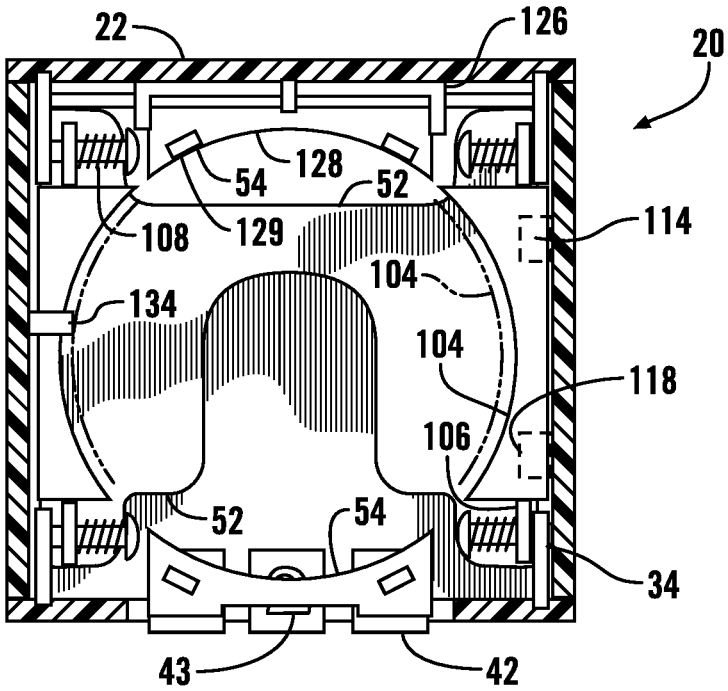
FIG. 6 is a cross-sectional view of the lid dispenser of FIG. 2 taken along section line 6-6, with the separators shown in phantom view in alternate position.

The pager assemblies 54 are mounted to the interior of the housing 22 on both the front wall 88 and the rear wall 90. As shown in FIG. 6, each pager assembly 54 has a mounting bracket 126 which is fixed to a housing wall, and a flipper 128 which is hingedly connected to the bracket. The flippers 128 may be provided with resilient pads 129 on their top surfaces which engage the stack of lids supported thereon. Two springs 130 extend between the flipper 128 and the bracket 126 and bias the flipper into a downward position. The flippers 128 are similar in shape to the side separators, being arcuate blade-like members, with a radius about that of the lids to be dispensed. The flipper 18 can pivot upwardly, but not downwardly, and when pivoted upwardly, the springs 130 will serve to restore it to an orientation which is substantially perpendicular to the axis of the lid stack. The carriage front wall 82 and the carriage rear wall 84 have cut-outs or relieved portions extending axially to avoid interference with the pagers across the length of the carriage's travel.

Figure 2:
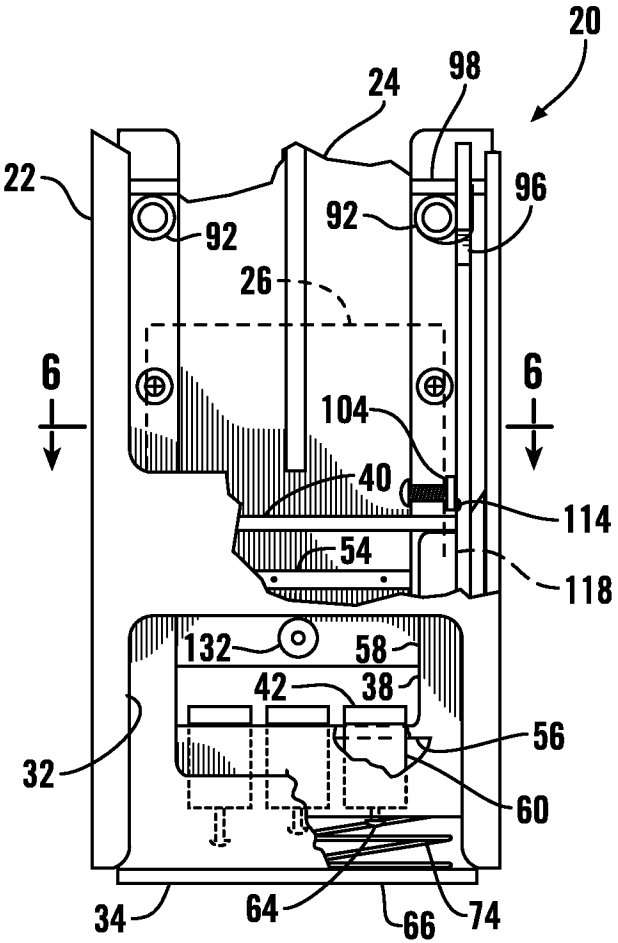
FIG. 2 is a front elevational view, partially broken away in section, of the lid dispenser of FIG. 1 in a retracted configuration.

As shown in FIG. 2, a generally cylindrical resilient bumper 132 is mounted to the rear wall 90 of the housing. The bumper 132 serves to absorb the impact of the carriage being returned to its uppermost position by the action of the constant force springs 92. Stack support fins 134 protrude inwardly from each of the side walls 94 and the rear wall 90, of the housing. A support fin 134 is also mounted to the loading door 30. The support fins 134 extend radially inwardly and serve to guide the stack of lids for axial travel within the housing.

The operation of the lid dispenser 20 is shown in FIGS. 2-5. To load the dispenser 20, the loading door 30 is opened and a stack 26 of lids 28 is placed within the interior 24 of the housing 22 to rest on the platform 40 of the traveler 38. The stack 26 then extends upward past the side separators 104 and is well above the level of the pager assemblies 54, as shown in FIG. 2. The lid stacks are shown schematically in the figures as broken-line rectangles for clarity, but it will be understood that a stack of lids is comprised of a plurality of generally nesting lids of formed thin sheets of plastic. As shown in FIG. 1, the lids are positioned with the top surface of the lid facing downward, and the peripheral flange of the lid extending upwardly.

Figure 3:
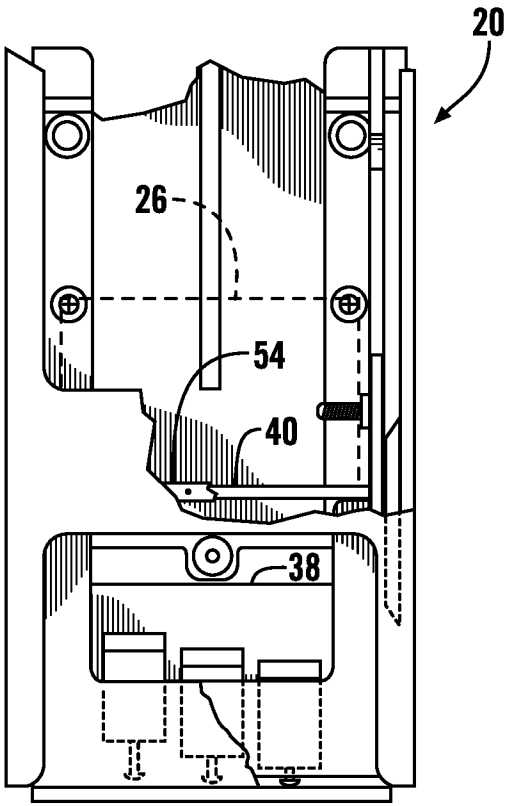
FIG. 3 is a front elevational view, partially broken away in section, of the lid dispenser of FIG. 2 in a configuration after a dispensing key has been depressed prior to engagement of the separators with the housing cams.

The operator, before operating the dispenser, determines how many lids it is desired to dispense. The key 42 with the indicium 43 indicating the selected number of lids is then depressed. In the following example, the key with the numeral "3" is depressed. The key 42, when depressed, engages the traveler lower wall 56 and drives the traveler with the entire stack of lids downwardly until the traveler 38 bottoms out within the carriage 34, as shown in FIG. 3. At this point, the side separators are positioned at a level slightly above a lower substack 136 of lids. These are the lids which will be dispensed in this operation. The other lids, the ones above the substack 136, comprise a remainder stack 138, and these, although continuing to move down with the substack at this stage, will be retained within the housing and will not be dispensed.

Figure 5:
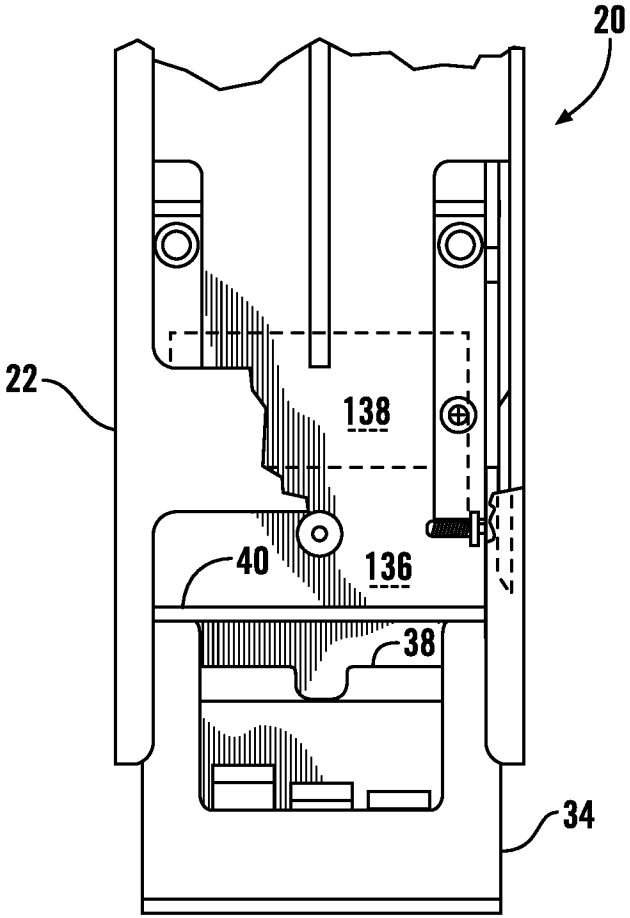
FIG. 5 is a front elevational view, partially broken away in section, of the lid dispenser of FIG. 4 in a configuration where the selected lids are presented for extraction by an operator at the housing outlet.
Figure 4:
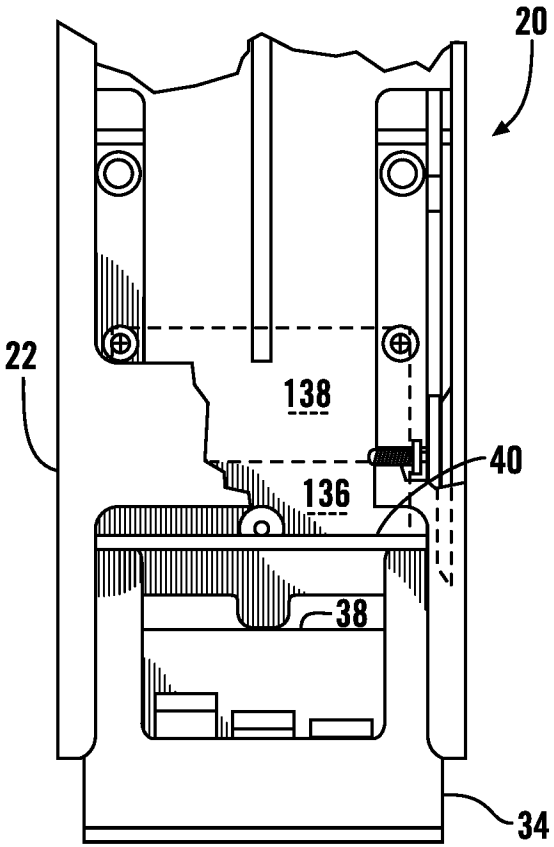
FIG. 4 is a front elevational view, partially broken away in section, of the lid dispenser of FIG. 3 in a configuration where the separators are engaged with the housing cams to separate the remainder stack of lids from the dispensed stack of lids.

As the operator continues to press down on the selected key 42, the full stack supported on the platform of the traveler moves downward with the carriage 34. As shown in FIG. 4, as the carriage moves past the cams 118 the side separators are driven radially inwardly to engage the remainder stack 138. As the carriage 34 moves past the pager assemblies 54, the lowermost lid of the substack 136 will engage the front and back flippers 128, but the side separators 104, which overlie the substack, will urge the entire substack downwards past the flippers. The remainder stack 138, which has no such downward force acting on it, will rest on the flippers 128 and will be retained thereon, as shown in FIG. 5, while the substack 136 will be supported on the traveler platform as it is presented to the operator for extraction through the dispensing outlet 32. The operator can grip the substack 136 from above and below the platform, which is cut-away at the front, permitting one-handed removal of the desired number of lids.

Once the lids are removed, the operator releases the key 42, at which point the constant force springs 92 act on the carriage 34 to return it to its uppermost configuration, ready to dispense again.

It will be noted that the flippers 128, due to their spring-loaded hinged condition, allow inadvertently dispensed lids to be returned to the lid stack. Any lids left on the platform will urge the flippers upwardly as the carriage is restored to its upper configuration.

Figure 7:
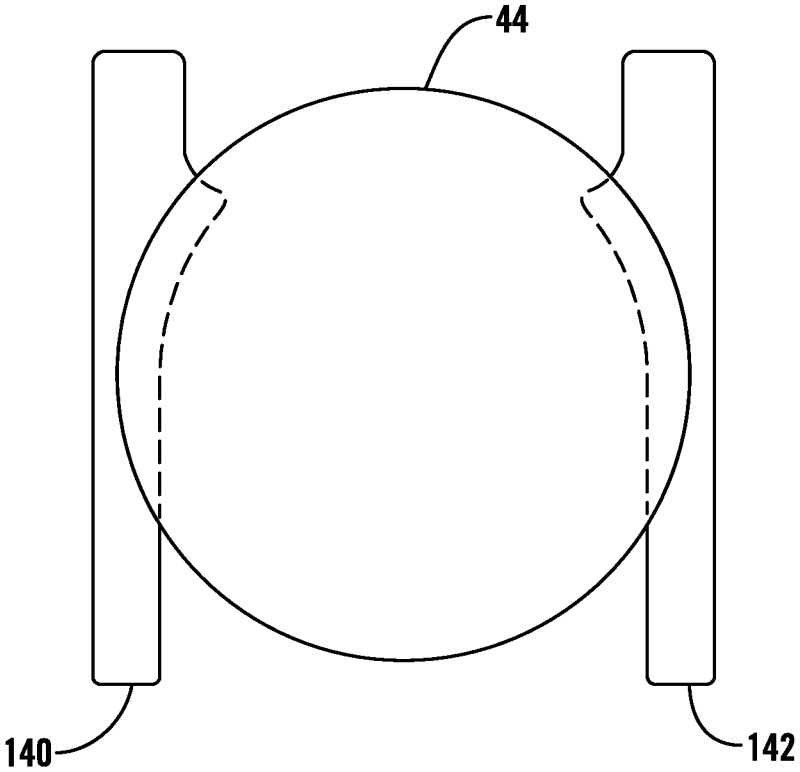
FIG. 7 is a top plan view of an alternative traveler platform for accommodating domed drink lids.

The lid dispenser 20 may be designed to accommodate different types and sizes of lids, for example by substituting pagers and side separators of different radius. As shown in FIG. 7, to accommodate dome lids 144, the traveler platform can be provided by two side elements 140, 142 which are not connected in the center, providing clearance for the dome, but still supporting the dispensed stack of lids on the edges.

It is noted that although three keys are indicated for selecting the quantity of lids to be dispensed, lid dispensers of this invention may be formed with more or fewer keys to enable the dispensing of the desired groupings of lids.

It is understood that the invention is not limited to the particular construction and arrangement of parts herein illustrated and described, but embraces all such modified forms thereof as come within the scope of the following claims.

I claim:

1. A lid dispenser comprising:

a housing having an interior which receives a stack of a plurality of lids, the stack defining an axial direction, the housing having a lower outlet;

a carriage mounted to the housing for axial motion thereon;

a traveler mounted to the carriage for axial motion thereon, wherein the traveler is biased towards an upper position on the carriage, and wherein the traveler has a platform which receives and supports lids thereon;

a plurality of keys arranged with respect to the traveler such that each key is actuatable to depress the traveler a different amount with respect to the upper position on the carriage and corresponding to a different quantity of lids it is desired to dispense;

at least one side separator mounted to the carriage above the traveler platform, and movable perpendicular to the axial direction;

at least one pager mounted to the housing to project into the housing interior beneath portions of the stack of lids, the at least one pager being positioned beneath the traveler platform in its upper position on the carriage; and elements mounted to the housing to cooperate with the at least one side separator to displace the at least one side separator towards the interior of the housing when the carriage is moved towards the housing outlet, to thereby engage and separate an upper remainder stack of lids from a lower substack of one or more lids supported on the platform for dispensing at the housing outlet, the at least one side separator urging the lower substack past the at least one pager as the carriage is moved towards the housing outlet, while the remainder stack is supported on the at least one pager.

2. The lid dispenser of claim 1 wherein the traveler has a lower wall, and further comprising:

a bottom wall fixed to the carriage;

a spring extending between the carriage bottom wall and the traveler lower wall to urge the traveler into the upper position, wherein each key has an axially extending element which limits the axial movement of the traveler with respect to the carriage, such that by depressing one or the other of the plurality of keys, a desired quantity of lids may be engaged on the platform for dispensing.

3. The lid dispenser of claim 1 wherein the housing has an axially extending side wall, and wherein the elements which are mounted to the housing to cooperate with the at least one side separator comprise:

at least one cam fixed to the housing side wall upwardly of the at least one pager; and portions of the at least one side separator which define a cam follower which engages the at least one cam as the carriage is moved axially towards the housing outlet to thereby displace the at least one side separator towards the interior of the housing.

4. The lid dispenser of claim 1 further comprising at least one constant force spring extending between the housing and the carriage to urge the carriage away from the housing outlet.

5. The lid dispenser of claim 1 wherein the traveler is telescopingly received within the carriage and wherein a plurality of protrusions on one of the traveler and the carriage are received within tracks on the other of the traveler and the carriage to guide the traveler in its axial travel within the carriage.

6. The lid dispenser of claim 5 further comprising a plurality of protrusions on one of the carriage and the housing which are received within tracks on the other of the carriage and the housing to guide the carriage in its axial travel within the housing.

7. The lid dispenser of claim 1 wherein the housing has a plurality of axially extending side walls, and further comprising stack support fins which project inwardly from the side walls to restrict displacement of a stack of lids.

8. The lid dispenser of claim 1 wherein the platform comprises two side elements, each fixed to the traveler, but not connected directly to one another, providing clearance for a stack of dome lids to be engaged thereon.

9. A method for dispensing a selected quantity of lids from a stack of lids stacked in an axial direction, comprising the steps of:

supporting a plurality of lids on a platform within a housing;

depressing the platform a preselected distance corresponding to the selected quantity of lids, to position the topmost lid of the quantity of lids to be dispensed beneath a separator element;

interposing the separator element at a position above the selected quantity of lids, and thereby defining a remainder stack of lids above the separator element;

moving the selected quantity of lids past a pager connected to the housing with the separator element, while the remainder stack is engaged by the pager and retained above the pager;

moving the platform axially to space the selected quantity of lids from the remainder stack; and presenting the selected quantity of lids on the platform spaced from the remainder stack for engagement and extraction by an operator.

10. The method of claim 9 wherein the step of depressing the platform a preselected distance comprises engaging one of a plurality of keys of various axial lengths, and depressing the engaged key to move the platform and the supported stack a preselected axial distance with respect to the separator element.

11. A lid dispenser configured to dispense one or a plurality of lids, comprising:

a housing having an interior which receives a stack of a plurality of lids, the stack defining an axial direction, the housing having a lower outlet;

a carriage mounted to the housing for axial motion thereon between an upper position and a dispensing position;

a traveler mounted to the carriage for axial motion thereon, wherein the traveler has a platform which receives and supports lids thereon;

elements engaged with the traveler and configured to displace the traveler one of a plurality of preselected distances with respect to the carriage, each of the plurality of preselected distances corresponding to a different quantity of lids it is desired to dispense;

at least one side separator mounted to the carriage above the traveler platform and movable perpendicular to the axial direction;

at least one pager mounted to the housing to project into the housing interior beneath portions of the stack of lids, the at least one pager being positioned beneath the traveler platform when the carriage is in its upper position; and elements mounted to the housing to cooperate with the at least one side separator to displace the at least one side separator towards the interior of the housing when the carriage is moved towards the housing outlet, to thereby engage and separate an upper remainder stack of lids from a lower substack of one or more lids supported on the platform for dispensing at the housing outlet, the at least one side separator urging the lower substack past the at least one pager as the carriage is moved towards the housing outlet, while the remainder stack is restrained from further axial displacement by the at least one pager.

12. The lid dispenser of claim 11 wherein the elements mounted to the housing to cooperate with the at least one side separator to displace the at least one side separator towards the interior of the housing comprise projecting members fixed to the housing to engage the at least side separator when the carriage is displaced axially to move past the projecting members.

13. The lid dispenser of claim 11 wherein the elements engaged with the traveler and configured to displace the traveler one of a plurality of preselected distances with respect to the carriage, comprise a plurality of keys of differing axial length, the keys being depressible to move the platform axially with respect to the carriage.

14. The lid dispenser of claim 11 wherein the at least one pager comprises a projection which extends inwardly from the housing and which has an arced inner edge.

15. A lid dispenser for dispensing lids from a stack of lids, the dispenser comprising:

a housing having an interior which receives a stack of a plurality of lids, the stack defining an axial direction, the housing having a lower outlet;

a carriage mounted to the housing for axial motion thereon between an upper position and a dispensing position;

a traveler mounted to the carriage for axial motion thereon, wherein the traveler has a platform which receives and supports lids thereon;

elements engaged with the traveler and configured to displace the traveler a preselected distance with respect to the carriage;

at least one side separator mounted to the carriage above the traveler platform and movable perpendicular to the axial direction;

at least one pager mounted to the housing to project into the housing interior beneath portions of the stack of lids, the at least one pager being positioned beneath the traveler platform when the carriage is in its upper position; and elements mounted to the housing to cooperate with the at least one side separator to displace the at least one side separator towards the interior of the housing when the carriage is moved towards the housing outlet, to thereby engage and separate an upper remainder stack of lids from a lower substack of one or more lids supported on the platform for dispensing at the housing outlet, the at least one side separator urging the lower substack past the at least one pager as the carriage is moved towards the housing outlet, while the remainder stack is restrained from further axial displacement by the at least one pager.

16. The lid dispenser of claim 15 wherein the elements mounted to the housing to cooperate with the at least one side separator to displace the at least one side separator towards the interior of the housing comprise projecting members fixed to the housing to engage the at least side separator when the carriage is displaced axially to move past the projecting members.

17. The lid dispenser of claim 15 wherein the at least one pager comprises a projection which extends inwardly from the housing and which has an arced inner edge.

18. The lid dispenser of claim 15 wherein the housing has an axially extending side wall, and wherein the elements which are mounted to the housing to cooperate with the at least one side separator comprise:

at least one cam fixed to the housing side wall upwardly of the at least one pager; and portions of the at least one side separator which define a cam follower which engages the at least one cam as the carriage is moved axially towards the housing outlet to thereby displace the at least one side separator towards the interior of the housing.

* * * * *